US009826610B2

(12) United States Patent
Miller et al.

(10) Patent No.: US 9,826,610 B2
(45) **Date of Patent: *Nov. 21, 2017**

(54) ELECTROSTATIC-DISSIPATION DEVICE

(71) Applicant: Moxtek, Inc., Orem, UT (US)

(72) Inventors: Eric Miller, Provo, UT (US); Steven West Wilson, Farmington, UT (US); Sanjay Kamtekar, Highland, UT (US); Bill Hansen, Manteca, CA (US); Brad Harris, Farmington, UT (US)

(73) Assignee: Moxtek, Inc., Orem, UT (US)

( * ) Notice: Subject to any disclaimer, the term of this patent is extended or adjusted under 35 U.S.C. 154(b) by 249 days.

This patent is subject to a terminal disclaimer.

(21) Appl. No.: 14/920,659

(22) Filed: Oct. 22, 2015

(65) Prior Publication Data

US 2016/0044768 A1 Feb. 11, 2016

Related U.S. Application Data

(63) Continuation-in-part of application No. 14/739,712, filed on Jun. 15, 2015.

(60) Provisional application No. 62/028,113, filed on Jul. 23, 2014, provisional application No. 62/079,295, filed on Nov. 13, 2014, provisional application No. 62/088,918, filed on Dec. 8, 2014, provisional application No. 62/103,392, filed on Jan. 14, 2014, provisional application No. 62/142,351, filed on Apr. 2, 2015, provisional application No. 62/159,092, filed on May 8, 2015, provisional application No. 62/079,295, filed on Nov. 13, 2014.

(51) Int. Cl.

| | |
|---|---|
| ***H05F 3/04*** | (2006.01) |
| ***H01J 9/24*** | (2006.01) |
| ***H01J 35/08*** | (2006.01) |

(52) U.S. Cl.

CPC ..... *H05F 3/04* (2013.01); *H01J 9/241* (2013.01); *H01J 35/08* (2013.01); *H01J 2235/086* (2013.01)

(58) Field of Classification Search

CPC ..... H05F 1/00; H05F 1/02; H05F 3/04; H05F 3/06; H01J 35/04; H01J 35/16; H05G 1/02; H05K 9/0067

USPC ..... 378/119–145

See application file for complete search history.

(56) References Cited

U.S. PATENT DOCUMENTS

| | | | |
|---|---|---|---|
| 3,970,884 | A | 7/1976 | Golden |
| 4,119,234 | A | 10/1978 | Kotschak et al. |
| 5,469,490 | A | 11/1995 | Golden et al. |
| 5,651,045 | A | 7/1997 | Pouvesle et al. |
| 6,205,200 | B1 | 3/2001 | Boyer et al. |
| 6,353,658 | B1 | 3/2002 | Trebes et al. |
| 6,563,110 | B1 | 5/2003 | Leri |

(Continued)

FOREIGN PATENT DOCUMENTS

| | | | |
|---|---|---|---|
| JP | 2000/267106 | A | 9/2000 |
| JP | 2002/352997 | A | 12/2002 |

(Continued)

*Primary Examiner* — Courtney Thomas

(74) *Attorney, Agent, or Firm* — Thorpe, North & Western, LLP

(57) ABSTRACT

An electrostatic-dissipation device comprising an x-ray tube and an electrically-conductive shell that is electrically coupled to an anode of the x-ray tube can be used for electrostatic dissipation, especially at a bottom side of a flat-panel-display (FPD).

19 Claims, 8 Drawing Sheets

(56) References Cited

U.S. PATENT DOCUMENTS

| | | | | |
|---|---|---|---|---|
| 6,570,959 | B1 | 5/2003 | Kuzniar | |
| 9,240,303 | B2 | 1/2016 | Barnum et al. | |
| 2004/0008818 | A1 | 1/2004 | Rangsten et al. | |
| 2005/0031083 | A1* | 2/2005 | Kindlein ..... | A61N 5/1001 378/136 |
| 2007/0188970 | A1 | 8/2007 | Inaba et al. | |
| 2008/0110397 | A1 | 5/2008 | Hyoung | |
| 2010/0074410 | A1 | 3/2010 | Ito et al. | |
| 2013/0308756 | A1 | 11/2013 | Bogan et al. | |
| 2015/0092924 | A1 | 4/2015 | Yun et al. | |

FOREIGN PATENT DOCUMENTS

| | | | |
|---|---|---|---|
| JP | 2006/049390 | A | 2/2006 |
| JP | 2014/514718 | A | 6/2014 |
| JP | 2014/143168 | A | 8/2014 |
| KR | 10-2004-0095587 | A | 11/2004 |
| KR | 10-2007-0071298 | A | 7/2007 |
| KR | 10-2013-0018540 | A | 2/2013 |

* cited by examiner

ELECTROSTATIC-DISSIPATION DEVICE

CLAIM OF PRIORITY

This is a continuation-in-part of U.S. patent application Ser. No. 14/739,712, filed on Jun. 15, 2015, which claims priority to U.S. Provisional Patent Application Nos. 62/028,113, filed on Jul. 23, 2014, and 62/079,295, filed on Nov. 13, 2014, all of which are hereby incorporated herein by reference in their entirety.

This claims priority to U.S. Provisional Patent Application Nos. 62/088,918, filed on Dec. 8, 2014, 62/103,392, filed on Jan. 14, 2015, 62/142,351, filed on Apr. 2, 2015, and 62/159,092, filed on May 8, 2015, and 62/079,295, filed on Nov. 13, 2014, which are hereby incorporated herein by reference in their entirety.

FIELD OF THE INVENTION

The present application is related generally to use of x-rays for electrostatic dissipation.

BACKGROUND

Static electric charges on some materials, such as electronic components for example, can discharge suddenly, resulting in damage to the material. For example, static electric charges can build up on flat-panel-displays (FPD for singular or FPDs for plural) during manufacture. Static charges on a bottom side of the FPD can discharge to a support table when the FPD is lifted off of the table, causing damage to the bottom side of the FPD. It can be beneficial to provide a conductive path with proper resistance level for a gradual dissipation of such charges. Gradual dissipation of these static charges can avoid damage to sensitive components.

SUMMARY

It has been recognized that it would be beneficial to provide a conductive path with proper resistance level for a gradual dissipation of static charges on various materials, including a bottom side of a flat-panel-display (FPD). The present invention is directed to embodiments of electrostatic-dissipation devices that satisfy these needs. Each embodiment may satisfy one, some, or all of these needs.

The electrostatic-dissipation device can comprise an x-ray tube and a shell. The x-ray tube can include a cathode and an anode electrically insulated from one another. The cathode can be configured to emit electrons towards the anode. The anode can be configured to emit x-rays out of the x-ray tube in response to impinging electrons from the cathode. The shell can carry the x-ray tube. The shell can be electrically-conductive. The shell can be electrically coupled to the anode and electrically insulated from the cathode.

DEFINITIONS

As used herein, the term "electrostatic discharge" means a rapid flow of static electricity from one object to another object. Electrostatic discharge can result in damage to electronic components.

As used herein, the term "electrostatic dissipation" means a relatively slower flow of electricity from one object to another object. Electrostatic dissipation usually does not result in damage to electronic components.

As used herein, the term "composite material" means a material that is made from at least two materials that have significantly different properties from each other, and when combined, the resulting composite material has different properties than the individual materials. Composite materials typically include a reinforcing material embedded in a matrix. One type of a composite material is carbon fiber composite which includes carbon fibers embedded in a matrix. Typical matrix materials include polymers, bismaleimide, amorphous carbon, hydrogenated amorphous carbon, ceramic, silicon nitride, boron nitride, boron carbide, and aluminum nitride.

DETAILED DESCRIPTION

Figure 1:
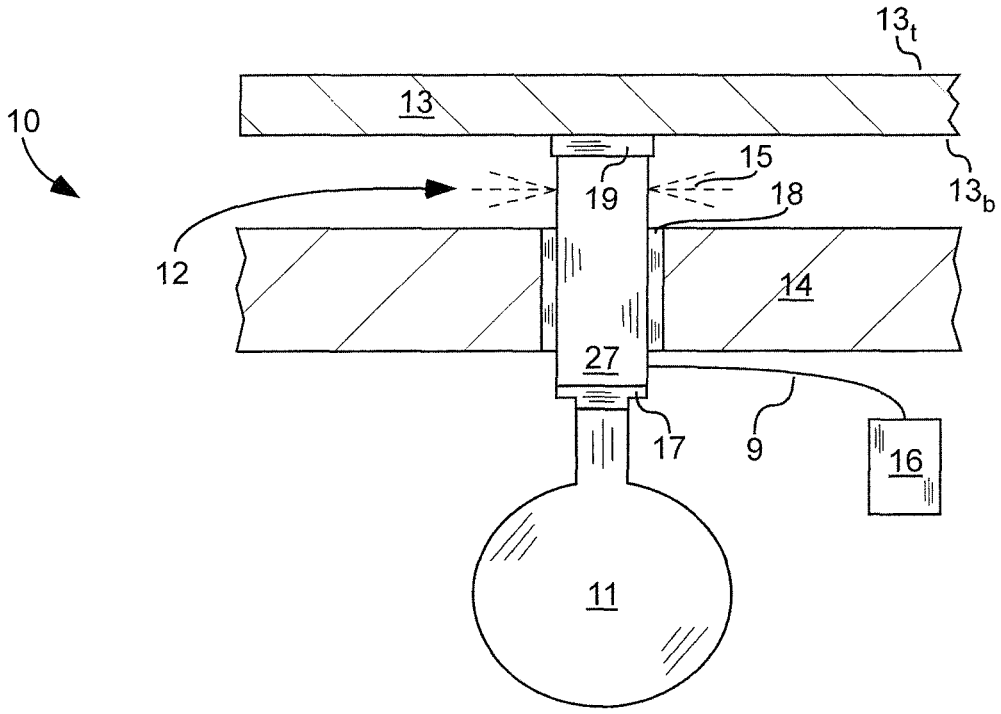
FIG. 1 is a schematic cross-sectional side-view of a flat-panel-display (FPD) manufacturing machine 10 and a schematic perspective view of an electrostatic-dissipation device 12, in accordance with an embodiment of the present invention.

Shown in FIG. 1 is a flat-panel-display (FPD) manufacturing machine 10 and an electrostatic-dissipation device 12. Electrostatic charges can build up on flat-panel-displays (FPD for singular or FPDs for plural) 13 during manufacture of the FPD 13. Rapid electrostatic discharge of such electrostatic charges can damage the FPD 13. Relatively slower electrostatic dissipation of such electrostatic charges can avoid this damage. Various methods have been used for electrostatic dissipation of electrostatic charges on a top side $13_t$ of the FPD 13. Electrostatic dissipation at an opposite, bottom side $13_b$ of the FPD 13 can be more difficult because a table 14, used to support the FPD 13, can block electrostatic dissipation equipment. Electrostatic-dissipation devices 12 described herein can be used for electrostatic dissipation, including electrostatic dissipation of the bottom side $13_b$ of the FPD 13.

The electrostatic-dissipation device 12 can be movably located in a hole in the table 14. A lifting-actuator 11 can be coupled to the electrostatic-dissipation device 12. The lifting-actuator 11 can lift the electrostatic-dissipation device 12 and press the electrostatic-dissipation device 12 against the FPD 13 to at least assist in lifting the FPD 13 off of the table 14. Although only one electrostatic-dissipation device 12 is shown in FIG. 1, typically, the FPD manufacturing machine 11 would include several such electrostatic-dissipation devices 12 and these multiple electrostatic-dissipation device 12 together would lift the FPD 13 off of the table 14.

Figure 2:
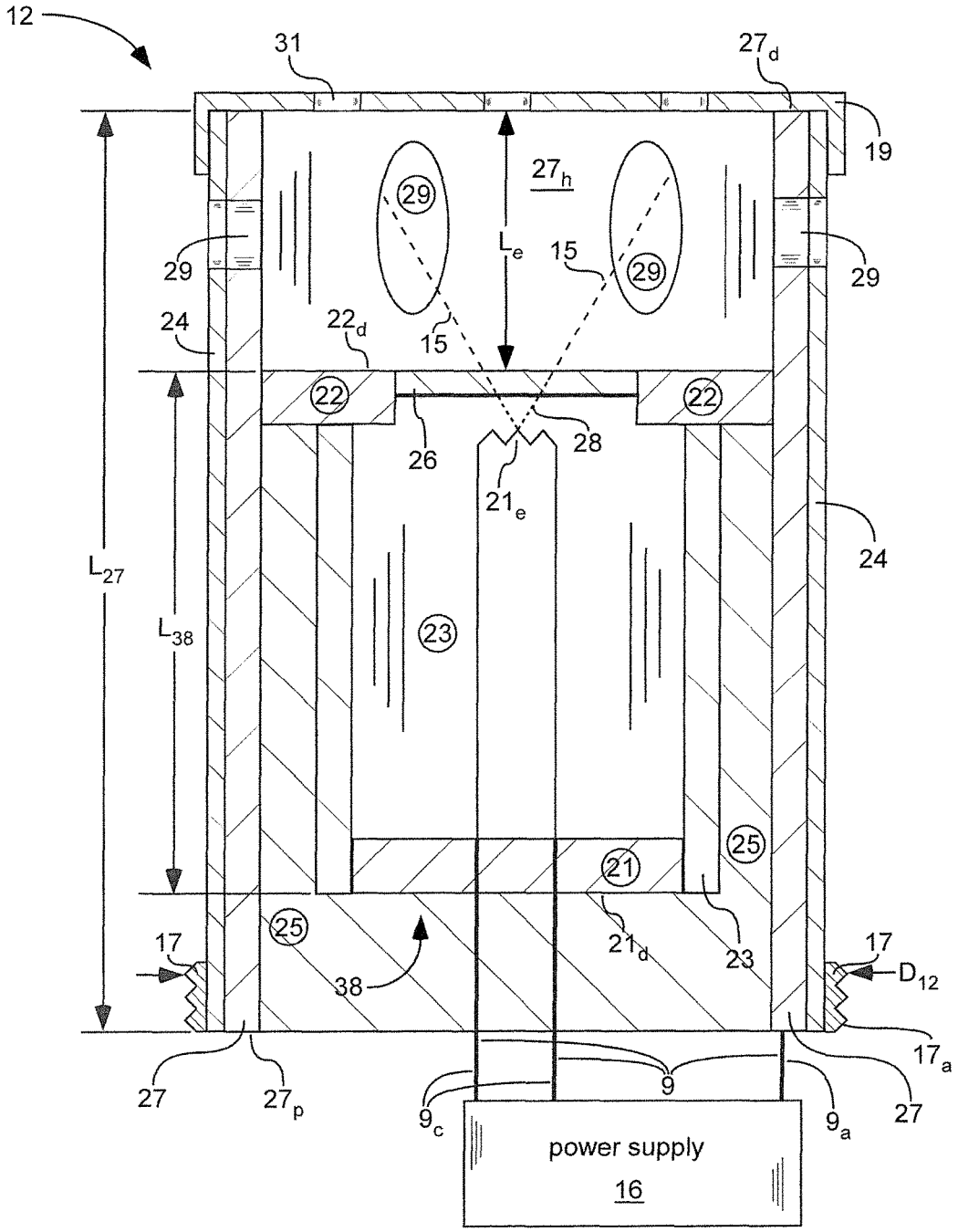
FIG. 2 is a schematic cross-sectional side-view of an electrostatic-dissipation device 12 including an x-ray tube 38 and a shell 27, in accordance with an embodiment of the present invention.

As shown in FIG. 2, the electrostatic-dissipation device 12 can include an x-ray tube 38 and a shell 27. The x-ray tube 38 can emit x-rays 15 between the table 14 and the bottom side $13_b$ of the FPD 13. These x-rays 15 can form ions in air between the FPD 13 and the table 14. These ions can dissipate electrostatic charges on the bottom side $13_b$ of the FPD 13, thus avoiding electrostatic discharge at and damage to the bottom side $13_b$.

The x-ray tube 38 can include a cathode 21 and an anode 22 which can be electrically insulated from one another. The cathode 21 can be configured to emit electrons towards the anode 22. The anode 22 can be configured to emit x-rays 15 out of the x-ray tube 38 in response to impinging electrons 28 from the cathode 21.

The shell 27 can carry the x-ray tube 38. The shell 27 can circumscribe at least a portion of the x-ray tube 38 or even a length $L_{38}$ of the x-ray tube 38. The shell 27 can be made of a structurally-strong material for carrying the table 14. Thus, by combining an x-ray tube 38 with the shell 27, the electrostatic-dissipation device 12 can lift the table 13 and allow x-rays to be emitted between and form ions between the table 14 and the FPD 13 and thus provide electrostatic dissipation of the difficult-to-access bottom side $13_b$ of the FPD 13.

The shell 27 can have a length $L_{27}$ longer than a length $L_{38}$ of the x-ray tube 38. The added length ($L_{27}$-$L_{38}$) can include an extension beyond a distal-end $21_d$ of the cathode 21 (away from the anode 22) to provide a protective region for connector cables 9 to a power supply 16.

The added length ($L_{27}$-$L_{38}$) can include an extension from a distal-end $22_d$ of the anode 22 (away from the cathode 21) to a distal end $27_d$ of the shell 27 to provide a hollow-region $27_h$ for protection of the x-ray tube 38, a region to allow x-rays 15 to expand outward, and a region for formation of ions. A region to allow x-rays 15 to expand outward can be important if the distal end $27_d$ of the shell is used to press against an FPD 13 and space is needed for x-rays 15 to emit out between the x-ray tube 38 and the FPD 13. The hollow-region $27_h$ can be vented, by vents 29 such as channels or holes, to allow passage of ions and x-rays 15 outward from the hollow-region $27_h$. The vents 29 can be spaces between a cage or between posts to provide the shell 27. The hollow-region $27_h$ can be mostly hollow to maximize the volume of air. A distal-end $27_d$ of the shell 27 can have a bearing surface to bear against the face of the FPD 13. The bearing surface of the shell 27 can be a non-marring or non-scratching surface, such as a Teflon® coating.

A proper length $L_e$ of the hollow-region $27_h$ from the distal end $22_d$ of the anode 22 to the distal end $27_d$ of the shell 27 can be important to allow space for x-rays to expand out into a gap between the table 14 and the FPD 13 but also allow space for the electrostatic-dissipation device 12 inside a hole of the table 14. For example, the hollow-region $27_h$ can extend beyond the distal end $22_d$ of the anode 22 for a distance $L_e$ of between 3 and 10 millimeters in one aspect or between 2 and 20 millimeters in another aspect.

A power supply 16 can provide electrical power to the x-ray tube 38. Due to space limitations, it can be difficult for the electrostatic-dissipation device 12 AND the power supply 13 to fit into the hole in the table 14, or other locations where electrostatic dissipation is needed. The x-ray tube 38 can be movably coupled to the power supply 13 by a cable 9, thus allowing the electrostatic-dissipation device 12 to fit into the hole in the table 14 and allowing the x-ray tube 38 to receive electrical power from a distant power supply 13. The cable can be at least 1 meter in one aspect, at least 2 meters in another aspect, or at least 4 meters in another aspect.

The cable 9 can include cathode-wires $9_c$, and an anode-wire $9_a$ as shown in FIG. 2. The cathode-wires $9_c$ can be used for heating the electron emitter $21_e$ and/or for supplying the electron emitter $21_e$ with a large negative voltage. The anode-wire $9_a$ can be electrically-coupled to the shell 27 and the shell 27 can be electrically coupled to the anode 22. The anode-wire $9_a$ can be electrically-coupled directly to the power supply 16; or the anode-wire $9_a$ can be electrically-coupled directly to a ground and the power supply 16 can electrically-coupled to ground.

Due to space limitations, it can be important for the electrostatic-dissipation device 12 to have a small outer diameter $D_{12}$ (see FIG. 2). For example, the electrostatic-dissipation device 12 can have a maximum-outer diameter $D_{12}$ of less than 40 millimeters in one aspect, less than 25 millimeters in another aspect, less than 20 millimeters in another aspect, or less than 15 millimeters in another aspect. The maximum-outer diameter $D_{12}$ of the electrostatic-dissipation device 12 means the maximum diameter of the shell 27, the sheath 24, the threads 17, or the cap 19, whichever is larger.

The shell 27 can be electrically-conductive, can comprise a conductive material, or can have a conductive coating, and can be a path to ground or to the power supply 16. The shell 27 can be electrically coupled to the anode 22 and electrically insulated from the cathode 21. Thus, the shell 27 can be used in place of a wire to the anode 22. Using the shell 27 as an electrical current path between a ground or the power supply 13 and the anode 22 can be important because of limited space in the hole in the table 14 where the electrostatic-dissipation device 12 can be located and it might be difficult to add a wire connecting the power supply 13 to the anode 22.

It can be important for the shell 27 to have reasonably low electrical conductivity in order to avoid unnecessary heat build-up on the shell 27 due to electrical current. For example, the shell can have an electrical resistivity of less than 0.02 ohm*m in one aspect, less than 0.05 ohm*m in another aspect, less than 0.15 ohm*m in another aspect, or less than 0.25 ohm*m in another aspect.

The shell can be made of a material with a thickness to allow the shell 27 to be a support for lifting the FPD. All or part of the shell 27, or the hollow-region $27_h$ of the shell 27, can be made of various composite materials, such as carbon fiber composite for example. These composite materials can be strong, electrically-conductive, and substantially transmissive to x-rays 15.

A sheath 24 can circumscribe some or all of the shell 27. The sheath 24 can be electrically resistive in order to avoid creating undesirable electrical-current paths away from the shell 27. For example, if the electrostatic-dissipation device 12 is used for lifting an FPD off of a table 14 during manufacture of the FPD, it can be desirable to avoid the shell 27 discharging electrical current through the table 14. The sheath 24 can be used to avoid such undesirable electrical current paths. Examples of electrical resistivity of the sheath 24 include greater than 100 ohm*m in one aspect or greater than 500 ohm*m in another aspect. The sheath 24 can be vented if it extends around the hollow-region $\mathbf{27}_h$ of the shell 27.

It can be important to avoid electrical current flow from the anode 22 to the FPD 13 through the shell 27. An electrically-resistive cap 19 can be located at the distal-end $\mathbf{27}_d$ of the shell 27. The cap 19 can be made of a sufficiently sturdy material to bear against a face of the FPD. The bearing surface of the cap 19 can be a non-marring or non-scratching surface, such as a Teflon® coating.

The cap 19 can include or can be a polymer, such as polyether ether ketone (PEEK) for example. The cap 19 can have an electrical resistivity of at least $5\times10^{13}$ ohm*m in one aspect, at least $1\times10^{14}$ ohm*m in another aspect, at least $2.5\times10^{14}$ ohm*m in another aspect, or at least $4.0\times10^{14}$ ohm*m in another aspect.

Figure 3:
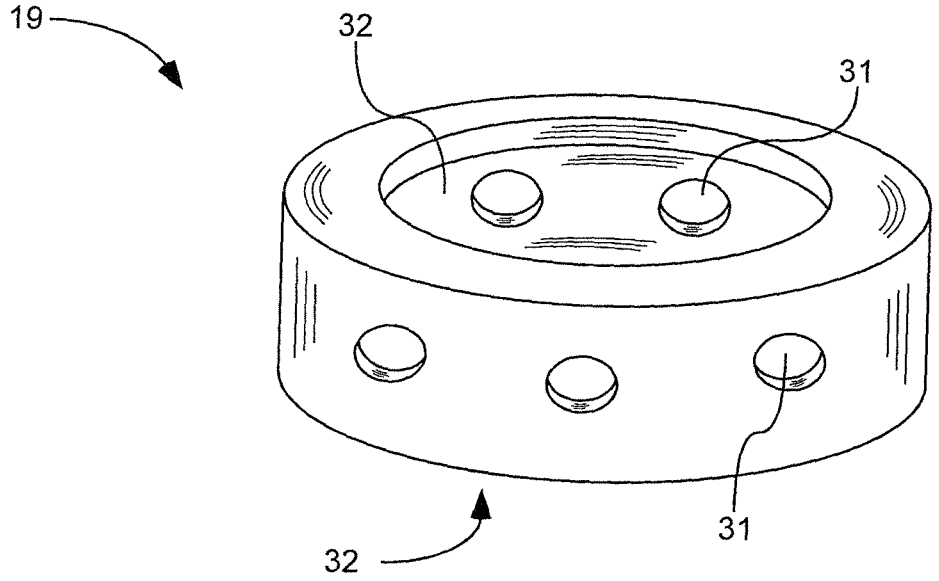
FIG. 3 is a schematic perspective view of a cap 19, in accordance with an embodiment of the present invention.

One example of a cap 19 is shown in FIG. 3. The cap 19 can have two open ends 32, forming a hollow within the cap 19, to allow convective heat transfer away from the x-ray tube 38. The cap 19 can also have vents 31 around a perimeter to allow improved x-ray 15 transmissivity and/or ion transfer away from the electrostatic-dissipation device 12.

The cap 19 can fit over the distal-end $\mathbf{27}_d$ of the shell 27 with a flange inserted inside or outside of the shell 27 or can be flat like a washer and can be attached to the shell 27 with an adhesive.

Although the vents 29 and/or 31 can aid in transfer of ions and x-rays, it can be beneficial for the shell 27, the sheath 24, and/or the cap 19 to be made of materials that are substantially transmissive of low-energy x-rays in order to also ionize air outside of the hollow-region $\mathbf{27}_h$. Low-atomic-number-materials can be more transmissive of x-rays. All or part of the shell 27, the hollow-region $\mathbf{27}_h$ of the shell 27, the sheath 24, the cap 19, or combinations thereof, can have a maximum atomic number of 8 in one aspect or 16 in another aspect and/or can have, at x-ray 15 energy of 10 keV, an x-ray transmissivity of greater than 40% in one aspect, greater than 45% in another aspect, greater than 50% in another aspect, greater than 60% in another aspect, or greater than 70% in another aspect. The x-ray 15 energy just described refers to energy of electrons 28 hitting a target material, energy of x-rays 15 emitted from the x-ray tube 38, and a bias voltage between the cathode 21 and the anode 22. For example, a 10 kV bias voltage between the cathode 21 and the anode 22 can result in 10 keV electrons 28 hitting the target and 10 keV x-rays 15 emitting from the x-ray tube 38. Materials with a relatively large mass percent of carbon can be useful due to the low atomic number of carbon (6). Beryllium is also useful due to its low atomic number of 4, but beryllium can be expensive and hazardous.

It can also be important for the shell 27 to be strong to protect the x-ray tube 38 from damage and to provide sufficient mechanical strength for lifting an FPD. The shell 27 and the x-ray tube 38 can be tube-shaped for ease of manufacturing and improved strength.

Important material characteristics of the shell 27 can be strength, x-ray 15 transmissivity, and electrical conductivity. The shell 27 can include or can consist of (i.e. be made of) a composite material, which can provide these characteristics. The term "composite material" typically refers to a material that is made from at least two materials that have significantly different properties from each other, and when combined, the resulting composite material can have different properties than the individual component materials. Composite materials typically include a reinforcing material embedded in a matrix. Typical matrix materials include polymers, bismaleimide, amorphous carbon, hydrogenated amorphous carbon, ceramic, silicon nitride, boron nitride, boron carbide, and aluminum nitride.

The shell 27 can include or can be made of a carbon fiber composite material. Electrical conductivity of the shell 27 can be improved by a relatively high percent of carbon fibers. For example, the shell 27 can include at least 60% volumetric percent carbon fibers in one aspect, at least 70% volumetric percent carbon fibers in another aspect, or at least 90% volumetric percent carbon fibers in another aspect.

The electrostatic-dissipation device 12 can have one or more connectors 17. One connector 17 can be an actuator-connector $\mathbf{17}_a$, at or near the proximal-end $\mathbf{27}_p$ of the shell 27 (closer to the cathode 21), for coupling the electrostatic-dissipation device 12 to the lifting-actuator 11. Another connector 17 can be a cap-connector $\mathbf{17}_c$, at or near the distal-end $\mathbf{27}_d$ of the shell 27 (closer to the anode 22), for coupling the electrostatic-dissipation device 12 to the cap 19. Types of connectors 17 include threaded, a sleeve connector, press-fit, and BNC. The connectors 17 can be attached to the shell 27 by a screw, adhesive, welding, etc.

Figure 4A:
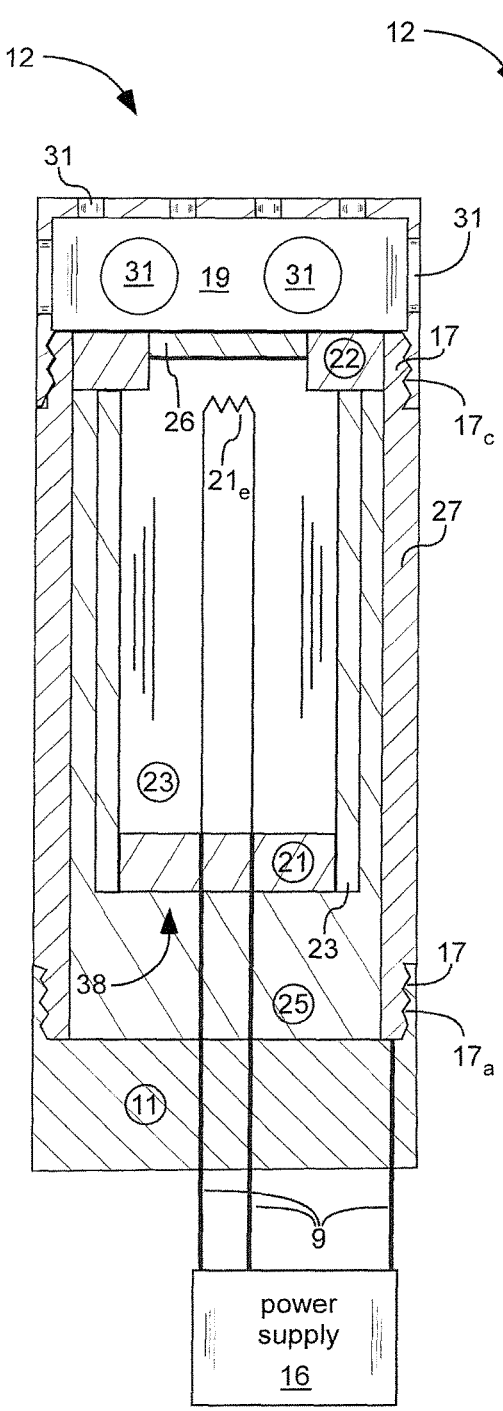
FIGS. 4*a* & 4*b* are a schematic cross-sectional side-views of an electrostatic-dissipation device 12 including (1) an x-ray tube 38, (2) a shell 27 with connectors 17, including a cap-connector $\mathbf{17}_c$ and an actuator-connector $\mathbf{17}_a$, both radially recessed, and (3) a cap 19, in accordance with an embodiment of the present invention.
Figure 4B:
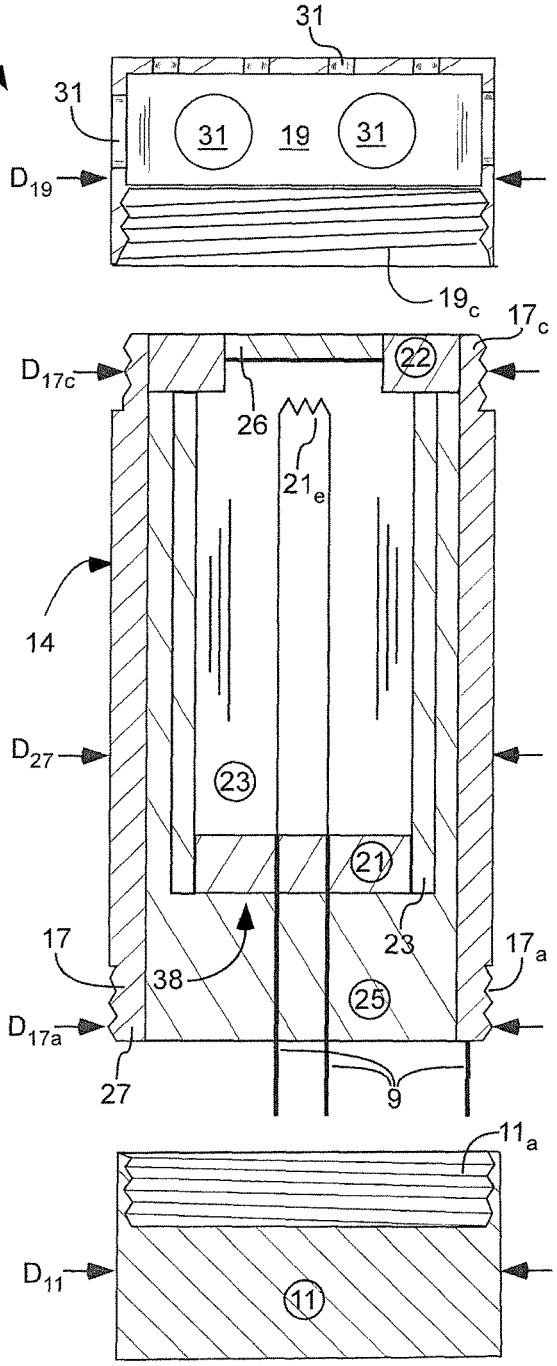

As shown in FIGS. 4*a* and 4*b*, the connectors 17 can be formed in or can be an integral-part of the shell 27. For example, threads machined or formed into the shell 27. One or both of the connectors 17 can be radially recessed, which can allow the actuator 11 and/or the cap 19 to have an outer diameter about the same as that of the shell 27, such that a radial-outer surface of the cap 19 and/or actuator 11 can be flush, or almost flush, with a radial-outer surface of the shell 27. This flush, or almost flush, radial-outer surface can allow the device to fit into a small hole in the table 14. "Almost flush" can mean that a maximum-outer diameter $D_{19}$ of the cap 19 and/or a maximum-outer diameter $D_{11}$ of the lifting-actuator 11 are not greater than a maximum-outer diameter $D_{27}$ of the shell 27 plus two millimeters ($D_{19}\leq D_{27}+2$ mm and/or $D_{11}\leq D_{27}+2$ mm).

A maximum-outer diameter $D_{17a}$ of the actuator-connector 17, can be less than a maximum-outer diameter $D_{27}$ of the shell 27. The actuator 11 can have an internal-connector $\mathbf{11}_a$ (e.g. threads) that can mate with the actuator-connector $\mathbf{17}_a$. A maximum-outer diameter $D_{17c}$ of the cap-connector $\mathbf{17}_c$ can be less than a maximum-outer diameter $D_{27}$ of the shell 27. The cap 19 can have an internal-connector $\mathbf{19}_c$ (e.g. threads) that can mate with the cap-connector $\mathbf{17}_c$.

As shown in FIGS. 2, 4*a*, and 4*b*, the cathode 21 can be electrically insulated from the anode 22 by an electrically-resistive enclosure 23 and by a vacuum within the electrically-resistive enclosure 23. The electrically-resistive enclosure 23 can be ceramic for strength and electrical resistivity. The electrically-resistive enclosure 23 can have an electrical resistivity of at least $1\times10^{12}$ in one aspect, at least $7\times10^{12}$ in another aspect, or at least $1\times10^{13}$ in another aspect.

Figure 5:
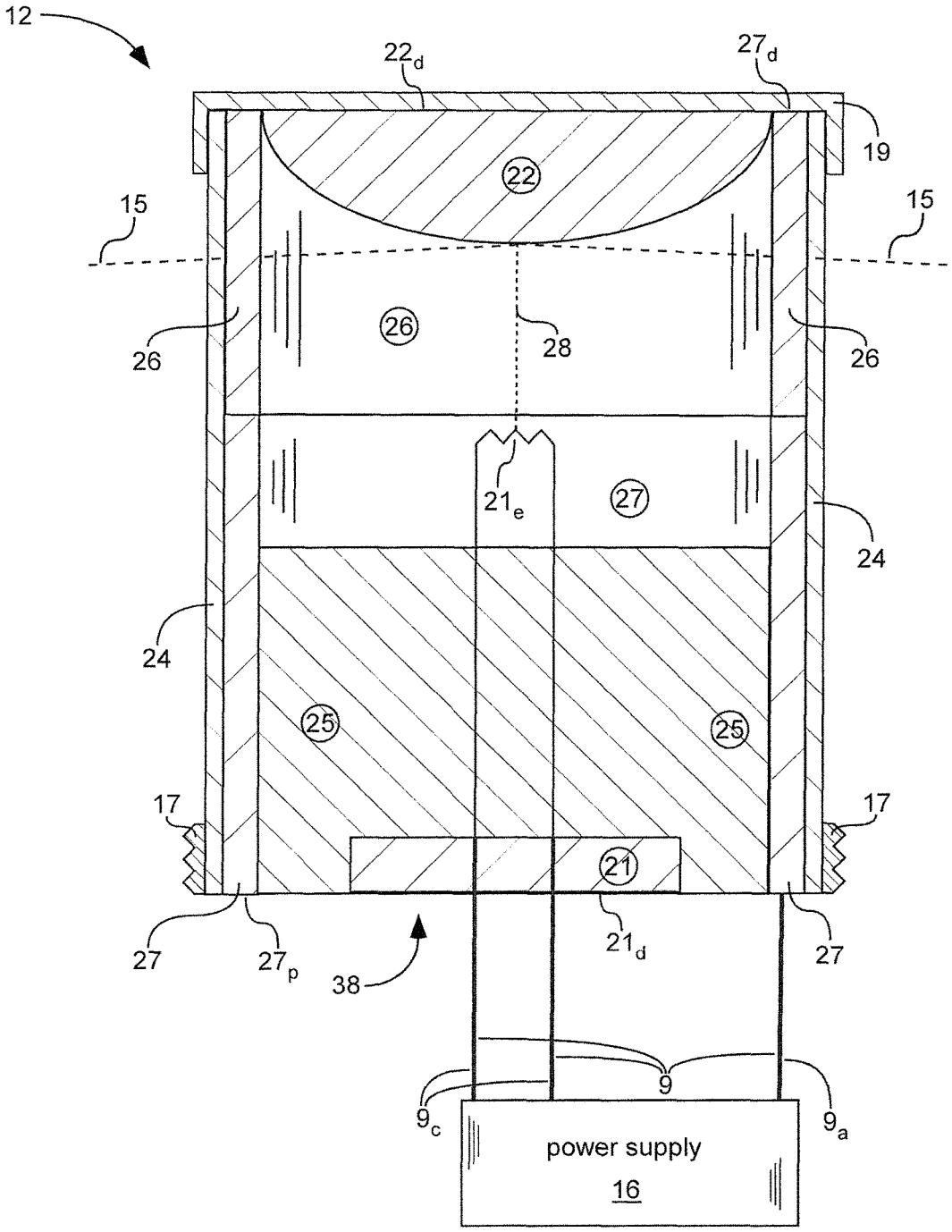
FIG. 5 is a schematic cross-sectional side-view of an electrostatic-dissipation device 12 including (1) a window 26 that forms an annular-segment of the shell 27, and (2) an anode 22 with a convex surface extending towards an electron emitter $\mathbf{21}_e$.

As shown in FIG. 5, the x-ray tube 38 can be made without the electrically-resistive enclosure 23 and the cathode 21 can be electrically insulated from the anode 22 by a vacuum within the shell 27. Also shown in FIG. 5, the shell 27 can include a window 26 configured for transmission of the x-rays 15. The window 26 can be electrically-conductive. The window 26 can form an annular-segment of the shell 27 and can have an annular shape for allowing x-rays 15 to emit outwards in a 360° arc in a latitudinal direction outward. A 360° emission of x-rays 15 can be effective at forming a large number of ions between the FPD and the table 14. The window 26 can form only part of a ring (e.g. 90° segment or 180° segment) for less than a 360° emission of x-rays 15, which can be beneficial if the electrostatic-dissipation device 12 is located at a corner or at an edge of the table 14. If the window 26 forms only part of the ring then the remainder of the shell 27 can be made of a material that substantially blocks x-rays 15 to avoid emitting x-rays 15 in unintended or undesirable directions.

The window 26 can encircle all or at least a portion of the anode 22. The window 26 can encircle all or at least a portion of the cathode 21. The window 26 can encircle all or at least a portion of the electron-emitter $\mathbf{21}_e$. The window 26 can have a transmissivity of greater than 60% for x-rays 15 having an energy of 1.74 keV. The window 26 can be a different section and different material than other portions of the shell 27 or the material of the window 26 can be the same as the entire shell 27 and thus the entire shell can be the window 26. The window 26 can comprise beryllium, carbon fiber composite, graphite, plastic, glass, boron carbide, or combinations thereof. Whether the window 26 is a segment of the shell or material of the window 26 is the same as the entire shell can be based on cost and manufacturability.

The window 26 can be made of a material and thickness for sufficient strength to support the FPD 13. The window 26 can include some or all of the properties (e.g. low deflection, high x-ray transmissivity, low visible and infrared light transmissivity) of the x-ray window described in U.S. patent application Ser. No. 14/597,955, filed on Jan. 15, 2015, which is incorporated herein by reference in its entirety.

As shown in FIG. 5, the anode 22 can have a protrusion or convex surface, such as a hemisphere or a half-ball-shape, extending towards the cathode 21 or electron emitter $\mathbf{21}_e$. The protrusion can improve voltage gradients, making easier emission of electrons 28 to the anode 22, and can allow 360° emission of x-rays 15. The convex surface can include the target material.

An electrically-insulative-material 25 can provide electrical insulation between at least parts of the x-ray tube 38, such as the cathode 21 and the shell 27. The electrically-insulative material 25 can have an electrical resistivity of greater than $1\times10^{12}$ ohm*m in one aspect or greater than $7\times10^{12}$ ohm*m in another aspect.

The electrically-insulative-material 25 can have a thermal conductivity of greater than 0.7

$$\frac{W}{m*K}$$

to aid in heat transfer from the x-ray tube 25 to the shell 27. Emerson and Cuming SYYCASE 2850, with thermal conductivity of about 1.02

$$\frac{W}{m*K}$$

and electrical resistivity of about $1\times10^{13}$ ohm*m, is one example of an electrically-insulative-material 25.

Figure 6:
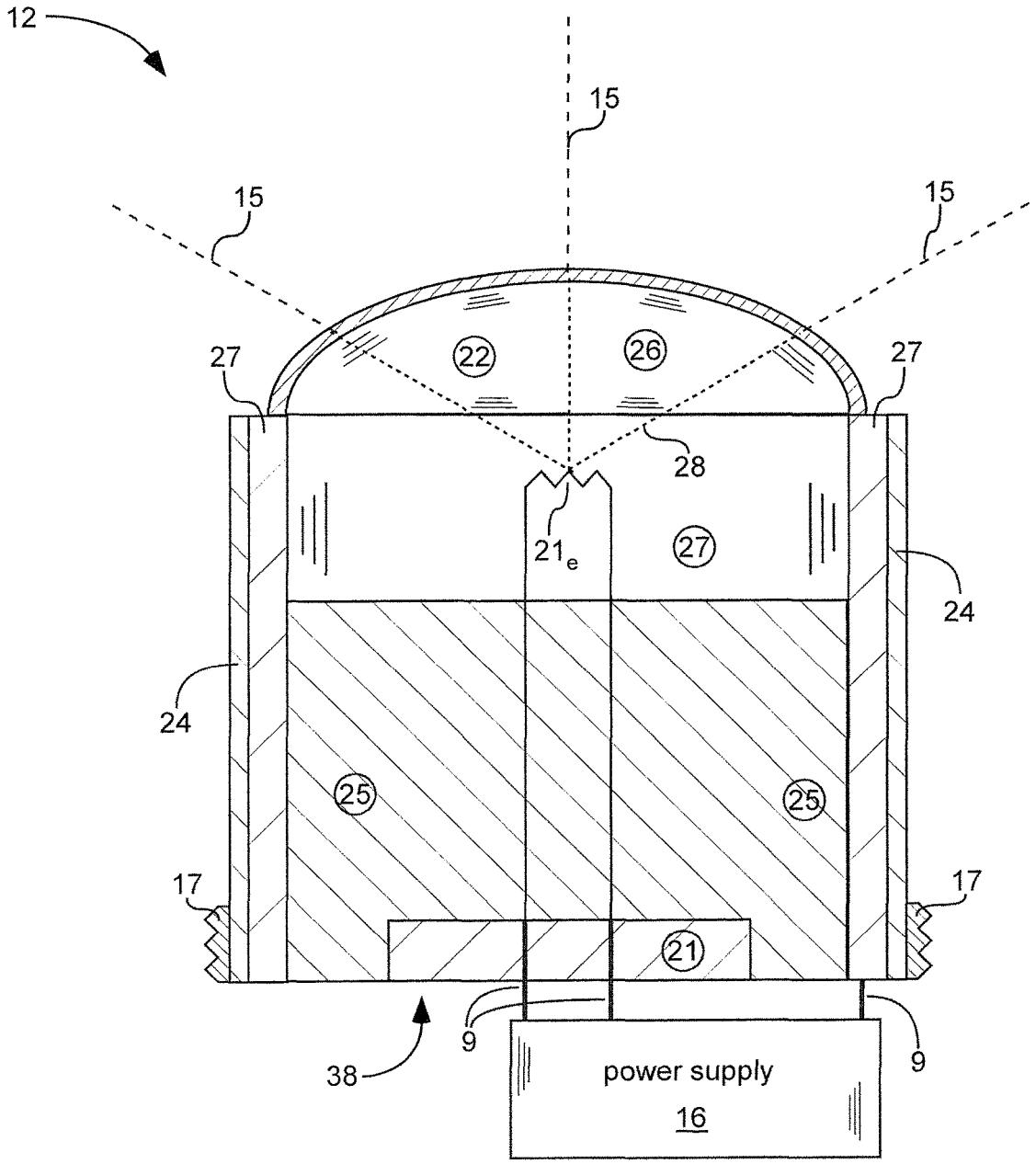
FIG. 6 is a schematic cross-sectional side-view of an electrostatic-dissipation device 12 including an anode 22 that is dome shaped with a concave-side facing the cathode 21 or electron emitter $\mathbf{21}_e$, a transmission anode 22 that is also the window 26, and a connector 17 located on the sheath 24.
Figure 7:
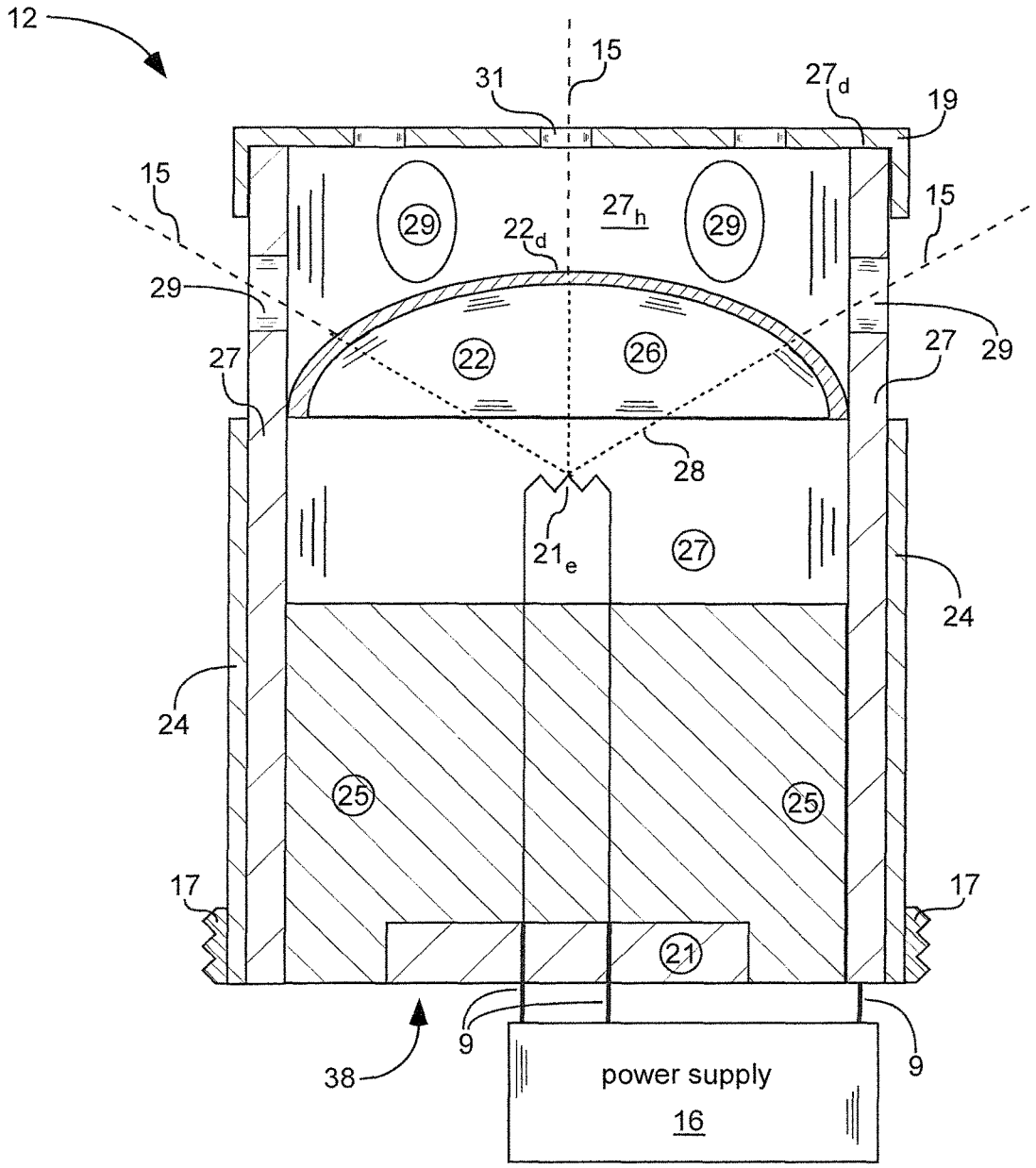
FIG. 7 is a schematic cross-sectional side-view of an electrostatic-dissipation device 12 including an anode 22 that is dome shaped with a concave-side facing the cathode 21 or electron emitter $\mathbf{21}_e$, a transmission anode 22 that is also the window 26, and a connector 17 located on the sheath 24.
Figure 8:
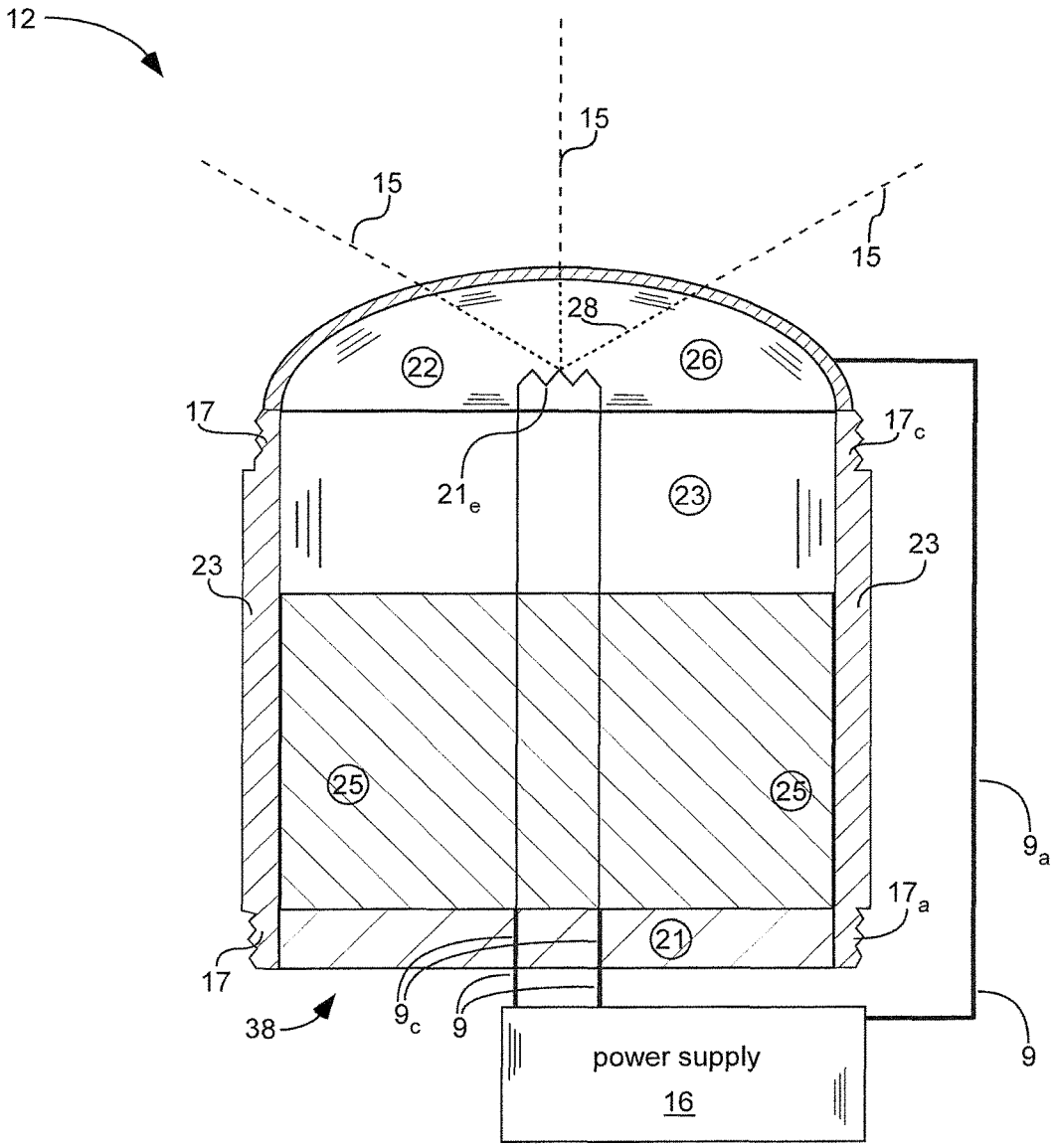
FIG. 8 is a schematic cross-sectional side-view of an electrostatic-dissipation device 12 including no shell; the anode 22 can be attached to an electrically-resistive enclosure 23; the anode 22 can be electrically-coupled to ground or to the power supply 16 by an anode-wire $\mathbf{9}_a$ or other electrically conductive path, and the electron emitter $\mathbf{21}_e$ can extend into a hollow within the dome of the anode 22; and a connector 17 located in the electrically-resistive enclosure 23.

Shown in FIGS. 6-8 are additional embodiments of the electrostatic-dissipation device 12 which can have characteristics described above, with the exception of the following. The electrostatic-dissipation device 12 embodiments shown in FIGS. 6-8 can include an anode 22 that is dome-shaped with a concave-side facing the cathode 21 or electron emitter $\mathbf{21}_e$. The anode 22 can be a transmission anode 22 and thus the anode is also the window 26. The electrostatic-dissipation device 12 embodiments shown in FIGS. 6-8 can emit x-rays 15 in a hemispherical-pattern, which can be beneficial for some applications, including for electrostatic dissipation of a bottom side $\mathbf{13}_b$ of an FPD.

As shown in FIGS. 6-7, the anode 22 can be electrically coupled to the shell 27. As shown in FIG. 7, the shell 27 can extend beyond a distal-end $\mathbf{22}_d$ of the anode 22 (away from the cathode 21) to a distal end $\mathbf{27}_d$ of the shell 27 to provide a hollow-region $\mathbf{27}_h$ for protection of the x-ray tube 38, a region to allow x-rays 15 to expand outward, and a region for formation of ions. As shown in FIG. 7, a cap 19 can be located on a distal end $\mathbf{27}_d$ of the shell.

As shown in FIG. 8, the electrostatic-dissipation device 12 can include one or more of the following: no shell 27; the anode 22 can be attached to an electrically-resistive enclosure 23; the anode 22 can be electrically-coupled to ground or to the power supply 16 by an anode-wire $\mathbf{9}_a$ or other electrically conductive path, and the electron emitter $\mathbf{21}_e$ can extend into a hollow within the dome of the anode 22.

As shown on the embodiments of the electrostatic-dissipation device 12 in FIGS. 6 and 8, the connectors 17 can be located in or on the electrically-resistive enclosure 23, the sheath 24, or the shell 27. As shown in FIG. 8, the connectors 17 can be recessed such that a radial-outer surface of the cap 19 and/or actuator 11 can be flush, or almost flush, with a radial-outer surface of the electrically-resistive enclosure 23. This flush, or almost flush, radial-outer surface can allow the device to fit into a small hole in the table 14. "Almost flush" can mean that a maximum-outer diameter of the cap 19 and/or a maximum-outer diameter of the lifting-actuator 11 are not greater than a maximum-outer diameter of the electrically-resistive enclosure 23 plus two millimeters.

The dome-shape of the anode 22 shown in FIGS. 6-8 can be made by pressing or forming the material (e.g. beryllium) into the dome-shape or by obtaining a sheet of material and machining out the dome-shape. The sheet can have about the same thickness as the final dome thickness. The sheet can be a single material (i.e. isotropic material characteristics in all directions). Use of a single material can avoid separation of different layers of materials. The anode 22 with the dome-shape can be made of a composite material, such as for example carbon fiber composite.

What is claimed is:

1. An electrostatic-dissipation device configured to dissipate static electricity between a flat-panel-display (FPD) and a table during manufacture of the FPD, the device comprising:

a. an x-ray tube, wherein:
   i. the x-ray tube includes a cathode and an anode electrically insulated from one another;
   ii. the cathode is configured to emit electrons towards the anode;
   iii. the anode is configured to emit x-rays out of the x-ray tube in response to impinging electrons from the cathode;

b. a shell, wherein the shell:
   i. carries the x-ray tube;
   ii. is electrically-conductive;
   iii. is electrically coupled to the anode and electrically insulated from the cathode;
   iv. has a proximal-end closer to the cathode and a distal-end closer to the anode;

v. has a connector, at the proximal-end, configured to be coupled to an actuator for lifting the FPD;

vi. includes a hollow-region between a distal-end of the anode and the distal-end of the shell, the hollow-region being vented to allow passage of ions and x-rays outward from the hollow-region; and c. a maximum outside diameter of less than 20 millimeters.

2. The device of claim 1, further comprising an electrically-insulative-material, wherein the electrically-insulative-material:

a. has a thermal conductivity of greater than 0.7

$$\frac{W}{m*K};$$

b. is located between the shell and the cathode; and c. electrically insulates the shell from the cathode.

3. The device of claim 1, further comprising a cap, wherein the cap:

a. is electrically-resistive;

b. is located on the distal-end of the shell; and c. is configured to bear against a face of the FPD.

4. The device of claim 3, wherein the cap is vented to allow passage of ions and x-rays outward from the hollow-region.

5. The device of claim 1, wherein the shell is made of a carbon fiber composite material.

6. The device of claim 1, wherein the shell has:

a. electrical resistivity of less than 0.05 ohm*m; and b. x-ray transmissivity greater than 40% at x-ray energy of 10 keV.

7. The device of claim 1, wherein a maximum atomic number of any material of the shell is 8.

8. The device of claim 1, wherein the shell substantially circumscribes a length of the x-ray tube and the shell has a length longer than the length of the x-ray tube.

9. The device of claim 1, wherein the hollow-region extends beyond the distal end of the anode for a length of between 3 and 10 millimeters.

10. The device of claim 1, further comprising a sheath, wherein the sheath:

a. circumscribes at least a portion of the shell and the anode;

b. has an electrical resistivity of greater than 100 ohm*m; and c. is configured to electrically insulate the shell from the table.

11. The device of claim 1, wherein the shell surrounding the hollow-region has x-ray transmissivity greater than 40% at x-ray energy of 10 keV.

12. An electrostatic-dissipation device comprising:

a. an x-ray tube, wherein:

i. the x-ray tube includes a cathode and an anode electrically insulated from one another;

ii. the cathode is configured to emit electrons towards the anode;

iii. the anode is configured to emit x-rays out of the x-ray tube in response to impinging electrons from the cathode;

b. a shell, wherein the shell:

i. circumscribes at least a portion of the x-ray tube and carries the x-ray tube;

ii. is electrically-conductive;

iii. is electrically coupled to the anode and electrically insulated from the cathode;

iv. has a proximal-end closer to the cathode and a distal-end closer to the anode;

v. includes a hollow-region at the distal-end of the shell and extending beyond a distal-end of the anode away from the cathode;

vi. has electrical resistivity less than 0.05 ohm*m; and vii. has a maximum atomic number of 8 for any material of the shell.

13. The x-ray source of claim 12, wherein:

a. the shell further comprises an actuator-connector;

b. the actuator-connector is located at the proximal-end;

c. the actuator-connector is configured to be coupled to an actuator for lifting a flat-panel-display;

d. the actuator-connector is radially recessed;

e. a maximum-outer diameter of the actuator-connector is less than a maximum-outer diameter of the shell.

14. The device of claim 12, further comprising an electrically-insulative-material, wherein the electrically-insulative-material:

a. is electrically-insulative;

b. has a thermal conductivity of greater than 0.7

$$\frac{W}{m*K};$$

c. is located between the shell and the cathode; and d. electrically insulates the shell from the cathode.

15. The device of claim 12, wherein the device forms part of an electrostatic dissipation system, the system comprising a power supply moveably coupled to the x-ray tube by a cable having a length of at least 2 meters.

16. An electrostatic-dissipation device configured to dissipate static electricity between a flat-panel-display (FPD) and a table during manufacture of the FPD, the device comprising:

a. an x-ray tube, wherein:

i. the x-ray tube includes a cathode and an anode electrically insulated from one another;

ii. the cathode is configured to emit electrons towards the anode;

iii. the anode is configured to emit x-rays out of the x-ray tube in response to impinging electrons from the cathode;

b. a shell, wherein the shell:

i. carries the x-ray tube;

ii. is electrically-conductive;

iii. is electrically coupled to the anode and electrically insulated from the cathode;

iv. has a proximal-end closer to the cathode and a distal-end closer to the anode; and v. has a connector, at the proximal-end, configured to be coupled to an actuator for lifting the FPD.

17. The device of claim 16, wherein:

a. the connector at the proximal-end of the shell is an actuator-connector;

b. the shell further comprises a cap-connector at the distal-end of the shell;

c. the cap-connector is configured to be coupled to a cap;

d. the actuator-connector and the cap-connector are both radially recessed;

e. a maximum-outer diameter of the cap-connector and a maximum-outer diameter of the actuator-connector are both less than a maximum-outer diameter of the shell.

18. The device of claim 17, further comprising the cap, wherein the cap has:

a. an internal-connector capable of mating with the cap-connector;

b. an outer diameter that is not greater than an outer diameter of the shell plus two millimeters;

c. a bearing surface configured to bear against the FPD.

19. The device of claim 17, wherein the shell is vented, the cap is vented, or both are vented.

* * * * *